US011846101B2

(12) United States Patent
Bixel

(10) Patent No.: US 11,846,101 B2
(45) **Date of Patent: *Dec. 19, 2023**

(54) ACOUSTIC CEILING BAFFLES AND RELATED METHODS OF USE

(71) Applicant: Nut Shell LLC, Redmond, WA (US)

(72) Inventor: Douglas Allan Bixel, Redmond, WA (US)

(73) Assignee: Nut Shell LLC, Woodinville, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/050,648

(22) Filed: Oct. 28, 2022

(65) Prior Publication Data

US 2023/0151608 A1 May 18, 2023

Related U.S. Application Data

(63) Continuation of application No. 17/230,554, filed on Apr. 14, 2021, now Pat. No. 11,492,803.

(60) Provisional application No. 63/010,470, filed on Apr. 15, 2020.

(51) Int. Cl.
*E04B 9/36* (2006.01)
*E04B 9/06* (2006.01)

(52) U.S. Cl.
CPC ..... *E04B 9/366* (2013.01); *E04B 9/068* (2013.01)

(58) Field of Classification Search
CPC ..... E04B 9/366; E04B 9/068
See application file for complete search history.

(56) References Cited

U.S. PATENT DOCUMENTS

| | | | |
|---|---|---|---|
| 3,969,870 | A | 7/1976 | Deaton |
| 4,200,171 | A | 4/1980 | Seymour et al. |
| 4,658,562 | A | 4/1987 | Brugman |
| 6,260,325 | B1 | 7/2001 | Wendt et al. |
| D723,359 | S | 3/2015 | O'Connor |
| 9,328,510 | B1 | 5/2016 | Springer et al. |
| 9,353,521 | B2 | 5/2016 | Waters |
| D852,029 | S | 6/2019 | Imai et al. |
| 10,407,904 | B2 | 9/2019 | Gillette et al. |

(Continued)

FOREIGN PATENT DOCUMENTS

| | | |
|---|---|---|
| DE | 202016001604 U1 | 4/2016 |
| DE | 202015000968 U1 | 5/2016 |

(Continued)

OTHER PUBLICATIONS

Non-Final Office Action dated Jan. 21, 2022 for U.S. Appl. No. 17/230,554.

*Primary Examiner* — Adriana Figueroa
(74) *Attorney, Agent, or Firm* — Dorsey & Whitney LLP

(57) ABSTRACT

An acoustic ceiling baffle that includes a baffle body and one or more attachment mechanisms disposed on a top edge of the baffle body configured to couple and decouple from a runner of a ceiling suspension system. The attachment mechanisms include a recessed portion that receives the runner. The recessed portion includes a first section and a second section with an opening disposed between the first section and the second section. The first section is configured to engage with a face of the runner when the acoustic ceiling baffle is coupled to the runner. The attachment mechanism further includes a first retention member and a second retention member formed around the recessed portion, each retention member comprising a bottom edge that is configured to engage with a top surface of a face of the runner.

20 Claims, 4 Drawing Sheets

(56) References Cited

U.S. PATENT DOCUMENTS

| | | | |
|---|---|---|---|
| 10,508,444 | B2 | 12/2019 | Gillette et al. |
| 10,584,488 | B2 | 3/2020 | Gillette et al. |
| 2006/0165482 | A1 | 7/2006 | Olberding |
| 2015/0068135 | A1 | 3/2015 | Waters |
| 2020/0002942 | A1 | 1/2020 | Headley et al. |
| 2021/0324627 | A1 | 10/2021 | Bixel |

FOREIGN PATENT DOCUMENTS

| | | | |
|---|---|---|---|
| EP | 3073021 | A1 | 9/2016 |
| WO | 2020124131 | A1 | 6/2020 |

ACOUSTIC CEILING BAFFLES AND RELATED METHODS OF USE

CROSS-REFERENCE TO RELATED APPLICATIONS

This application is a continuation of U.S. application Ser. No. 17/230,554, filed Apr. 14, 2021, and titled ACOUSTIC CEILING BAFFLES AND RELATED METHODS OF USE, which claims priority to U.S. Provisional Application No. 63/010,470, filed Apr. 15, 2020, and titled ACOUSTIC CEILING BAFFLES AND RELATED METHODS OF USE, each of which is hereby incorporated by reference in its entirety.

TECHNICAL FIELD

The present disclosure relates generally to the field of ceiling suspension systems for absorbing sound energy. More particularly, some embodiments relate to acoustic ceiling baffles that absorb sound energy in a ceiling suspension system.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
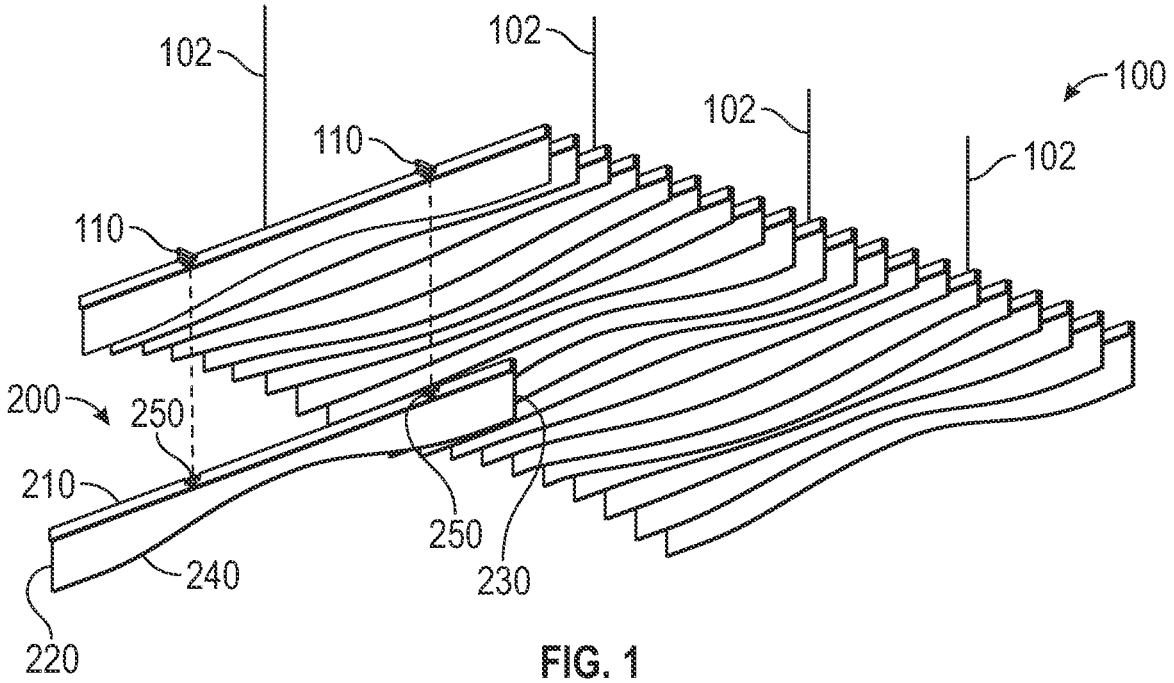
FIG. 1 illustrates a bottom perspective view of a ceiling suspension system that includes runners and a plurality of acoustic ceiling baffles according to one embodiment of the present disclosure.

Many locations are filled with various sources of sound and/or noise, including people, vehicles, music players, computers, televisions, appliances, musical instruments, etc. These sounds may cause confusions, strain, anxiety, privacy concerns, and/or miscommunication. Accordingly, sound dampening and/or acoustic materials may be used to absorb, dampen, reflect, etc., sound energy in an attempt to control the sound in a desired manner.

The present disclosure relates to acoustic ceiling baffles used to absorb, dampen, and/or reflect sound energy in a ceiling suspension system. The embodiments may be best understood by reference to the drawings, wherein like parts are designated by like numerals throughout. It will be readily understood that the components of the present disclosure, as generally described and illustrated in the drawings herein, could be arranged and designed in a wide variety of different configurations. Thus, the following more detailed description of the embodiments is not intended to limit the scope of the disclosure, but is merely representative of possible embodiments of the disclosure. In some cases, well-known structures, materials, or operations are not shown or described in detail. While the various aspects of the embodiments are presented in drawings, the drawings are not necessarily drawn to scale unless specifically indicated.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method. Furthermore, the terms "comprise," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The phrase "coupled to" is broad enough to refer to any suitable coupling or other form of interaction between two or more entities, including mechanical interaction. Two components may be coupled to each other even though they are not in direct contact with each other. Objects described herein as being "adjacent" to each other may be in physical contact with each other, in close proximity to each other, or in the same general region or area as each other, as appropriate for the context in which the phrase is used.

Figure 2:
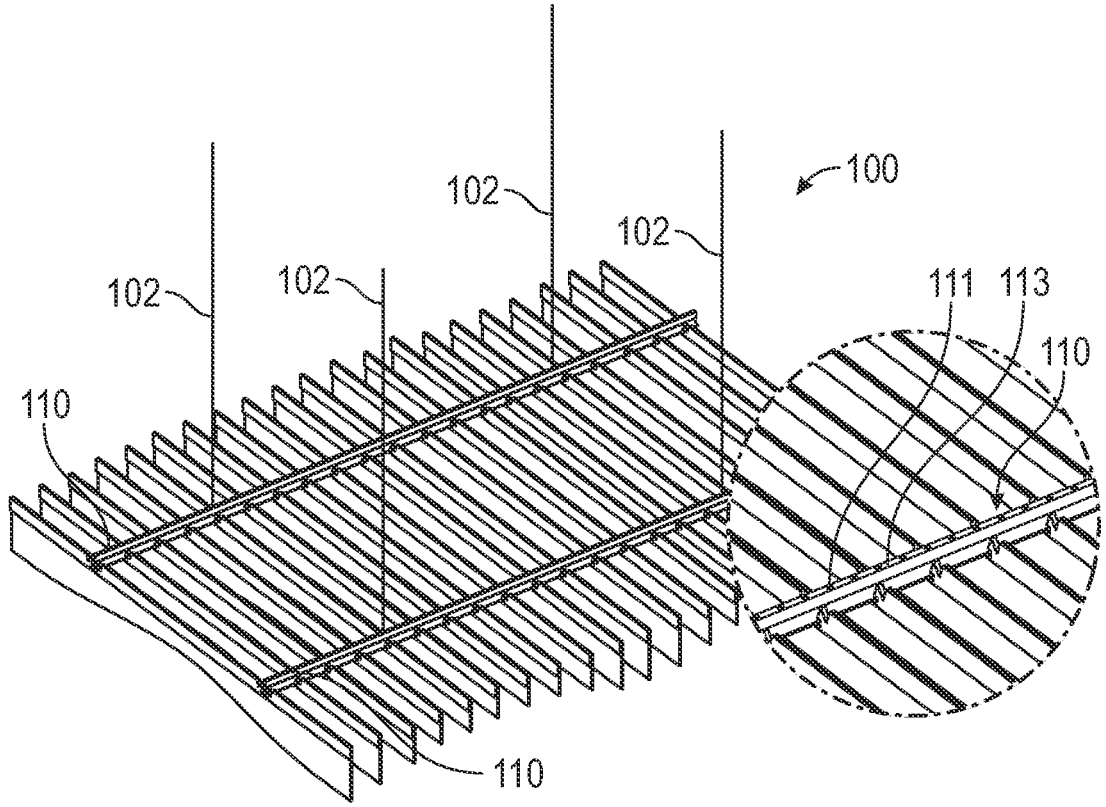
FIG. 2 illustrates a top perspective view of the ceiling suspension system of FIG. 1.

FIGS. 1 and 2 illustrate perspective views of a ceiling suspension system 100. FIG. 1 illustrates a bottom perspective view and FIG. 2 illustrates a top perspective view. The ceiling suspension system 100 may be an exposed mounting system. The illustrated ceiling suspension system 100 includes a plurality of runners 110 and a plurality of ceiling baffles 200 that are coupled to the plurality of runners 110. The runners 110 extend in a first direction and the plurality of runners 110 are parallel to each other and are spaced laterally apart a predetermined amount of distance, such as four feet. In some embodiments, the ceiling suspension system 100 comprises a single runner 110. In other embodiments, the ceiling suspension system 100 comprises two runners 110. In further embodiments, the ceiling suspension system 100 comprises three or more runners 110.

As shown in FIGS. 1 and 2, the runners 110 may be suspended and/or hung from a ceiling or wall structure. For instance, in the illustrated embodiment, the runners 110 are suspended by a plurality of suspension wires or cables 102. The suspension wires or cables 102 support the runners 110 at a predetermined distance from the ceiling. In other instances, the runners 110 and are suspended by a wall structure (e.g., between two or more wall structures extending vertically from a floor structure). As illustrated in the detailed view of FIG. 2, the runners 110 may comprise a plurality of apertures 111 in a top surface 109 of the runner 110 that may be used to couple the suspension wire or cable 102 to the runner 110.

As illustrated in FIGS. 1 and 2, the ceiling baffles 200 are coupled to the runners 110 via attachment mechanisms 250. Each ceiling baffle 200 comprises a baffle body with a top edge 210, a left edge 220, a right edge 230, and a bottom edge 240. The attachment mechanisms 250 are disposed in or along the top edge 210 of the ceiling baffle 200. FIG. 1 illustrates either the ceiling baffle 200 in the process of being coupled or decoupled to the runner 110 via the attachment mechanisms 250.

The ceiling baffles 200 have a predetermined depth that extends in the longitudinal direction of the runners 110. Each ceiling baffle 200 may have a similar design, or as shown in the illustrated embodiment, each ceiling baffle 200 may have a different design. For example, the illustrated embodiment illustrates that each ceiling baffle 200 has a different curvature along the length of the bottom edge 240, and the height of the left edge 220 and the right edge 230 may be different. This may provide a visual or aesthetic appeal to the ceiling suspension system 100 when installed. The present disclosure is not limited to the designs illustrated, but encompasses a variety of different designs.

Figure 3:
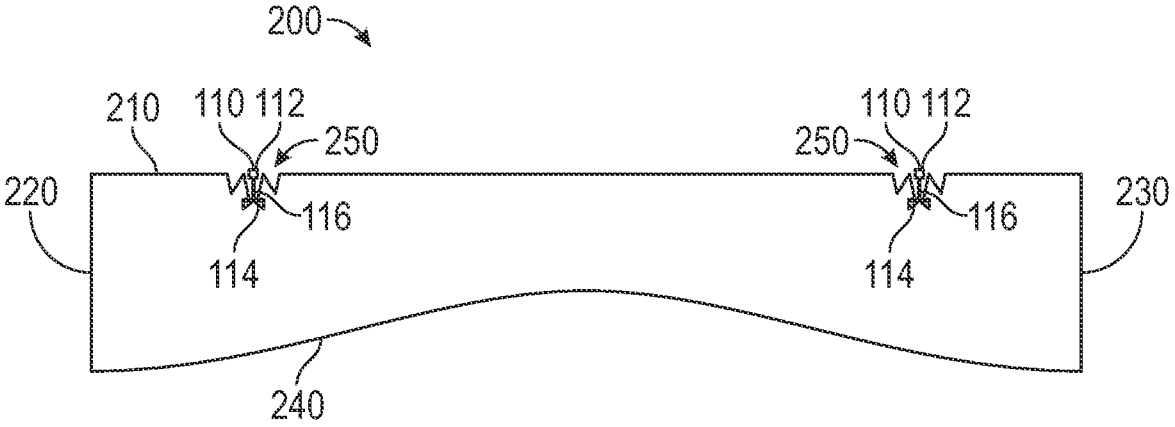
FIG. 3 illustrates a front end view of the ceiling suspension system of FIGS. 1 and 2.

FIG. 3 illustrates a front end view of the ceiling suspension system 100. For ease of illustration, only a single baffle 200 is illustrated; however, there may be multiple ceiling baffles 200 disposed behind the ceiling baffle illustrated.

As discussed above, the ceiling baffle 200 comprises the top edge 210, the left edge 220, the right edge 230, and the bottom edge 240 with a predetermined depth. Each ceiling baffle 200 may have one or more attachment mechanisms 250. The attachment mechanism 250 is configured to removably couple to the runner 110. The attachment mechanisms 250 may be laterally spaced apart, such as about four feet. The distance between the attachment mechanism and the lateral edges, e.g. left edge 220 or right edge 230 may vary.

The illustrated embodiment shows two attachment mechanisms 250; however, the present disclosure is not so limited, and the number of attachment mechanisms 250 may be one, two, three, or more. The ceiling suspension system 100 may have the same corresponding number of runners 110 as attachment mechanisms 250 on the ceiling baffle 200. The structural details of various attachment mechanisms are discussed in further detail below.

The illustrated embodiment of FIG. 3 illustrates a front end view of the runners 110. One runner 110 is disposed on the left and another runner 110 is disposed on the right. These runners 110 couple with the attachment mechanism 250 to attach the ceiling baffle 200 to the runners 110. The runners 110 comprise a bulb 112 that is formed on an upper portion or ridge of the runner 110. The illustrated embodiment shows the bulb 112 has a rectangular cross-section. Other shapes are also contemplated. For example, in other embodiments, the cross-section of the bulb 112 may be triangular, round, circular, oval, polygonal, and the like. The bulb 112 may add structural load strength to the runner 110. The runners 110 further comprise a face 114 and a web 116 that extends between and couples the face 114 to the bulb 112. The face 114 may extend laterally as far as or farther than the bulb 112.

The acoustic ceiling baffles 200 may be coupled to the runners 110 of the ceiling suspension system 100 to absorb, dampen, and/or reflect sound energy. Each acoustic ceiling baffle 200 may comprise various types of sound dampening materials. Exemplary sound dampening materials that can be used include, but are not limited to, cotton, rayon, acetate, nylon, wood, olefins (or polyolefins), polyesters, acrylics, fiberglass, petroleum based fibers, biofibers (e.g., fibers manufactured from soybean oil, corn oil, sugar cane, bamboo, etc.) and mixtures thereof. In certain embodiments, the acoustic ceiling baffle 200 comprises polyester and/or fiberglass. In a particular embodiment, the acoustic ceiling baffle 200 comprises polyester. And in another particular embodiment, the acoustic ceiling baffle 200 comprises fiberglass. In certain embodiments, the sound dampening material is fibrous. For example, the acoustic ceiling baffles 200 may comprise fiberglass, a spunbonded olefin, or a spunbonded polyester sound dampening material. In some embodiments, the fibrous material can also be an extruded fibrous material.

The sound dampening material of the acoustic ceiling baffle 200, and/or layers of acoustic ceiling baffle 200, can also be non-woven. Non-woven materials can be useful in acoustic sound control due to their porous structure, high surface area, and low cost of production. The non-woven materials may also be porous. For example, non-woven materials can have a porosity greater than 70%, 80%, or 90%. This porosity can increase the amount of sound energy the acoustic ceiling baffle 200 may absorb.

In some embodiments, the acoustic ceiling baffle 200 comprises mixtures of different types of sound dampening materials (such as mixtures of different types of polyesters). For example, the acoustic ceiling baffle 200 can comprise a high melt material and a low melt material (e.g., such as high and low melt polyesters). High melt materials can refer to materials having a melting point greater than about 330° F., such as between about 330° F. and about 450° F. Low melt materials can refer to materials having a melting point lower than about 320° F., such as between 220° F. and about 320° F. For instance, in a particular embodiment, the acoustic ceiling baffle 200 comprises a mixture of at least one high melt polyester having a melting point greater than about 330° F., such as between about 330° F. and about 450° F., and at least one low melt polyester having a melting point lower than about 320° F., such as between 220° F. and about 320° F. In some of these embodiments, the acoustic ceiling baffle 200 may comprise between about 50% and 95%, or between about 70% and 90% by weight of a high melt material, and between about 5% and 50%, or between about 10% and 30% by weight of a low melt material.

The acoustic ceiling baffle 200 may also comprise acoustic materials having various weights, thicknesses, or deniers. For example, in certain embodiments, the acoustic materials can comprise a first portion of fibers having a first average denier and a second portion of fibers having a second average denier. In some of such embodiments, the first average denier is smaller than the second average denier. Additional sizes, such as a third average denier, fourth average denier, etc., can also be used.

As previously indicated, the acoustic ceiling baffle 200 may be configured to absorb, dampen, and/or reduce acoustic energy. In some embodiments, the acoustic ceiling baffle 200 may reduce acoustic energy by at least 20%, at least 30%, at least 40%, at least 50%, at least 60%, at least 70%, at least 80%, or at least 90%. In other embodiments, the acoustic ceiling baffle 200 may reduce acoustic energy in an amount ranging from 50% to 90%. The standard for measuring such a reduction of acoustic energy may be a Noise Reduction Coefficient (NRC) as tested under ASTM C423.

In some embodiments, the acoustic ceiling baffle 200 can comprise a plurality of layers that are fabricated into a mat. In some of such embodiments, fabrication of the acoustic ceiling baffle 200 comprises disposing acoustic material into two or more layers. The acoustic material can then be treated. For example, the acoustic material can be compressed and/or subjected to heat or elevated temperatures, such as with a hot iron or heat press to form a mat. Other manufacturing methods and/or processes can also be used. For example, in some embodiments, acoustic materials can be entangled within a layer. Entanglement can occur prior to laying the adjacent layer (e.g., second layer) or after laying the adjacent layer.

Figure 4:
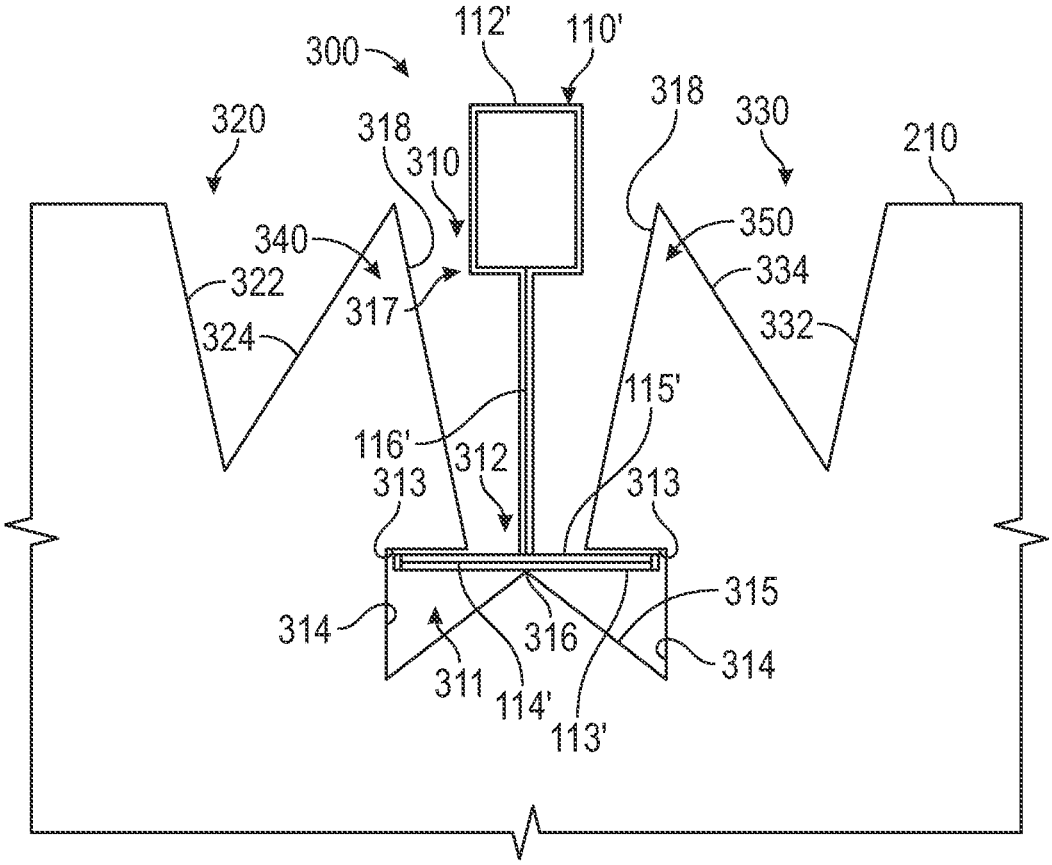
FIG. 4 illustrates a detailed view of an attachment mechanism of an acoustic ceiling baffle according to one embodiment of the present disclosure.
Figure 5:
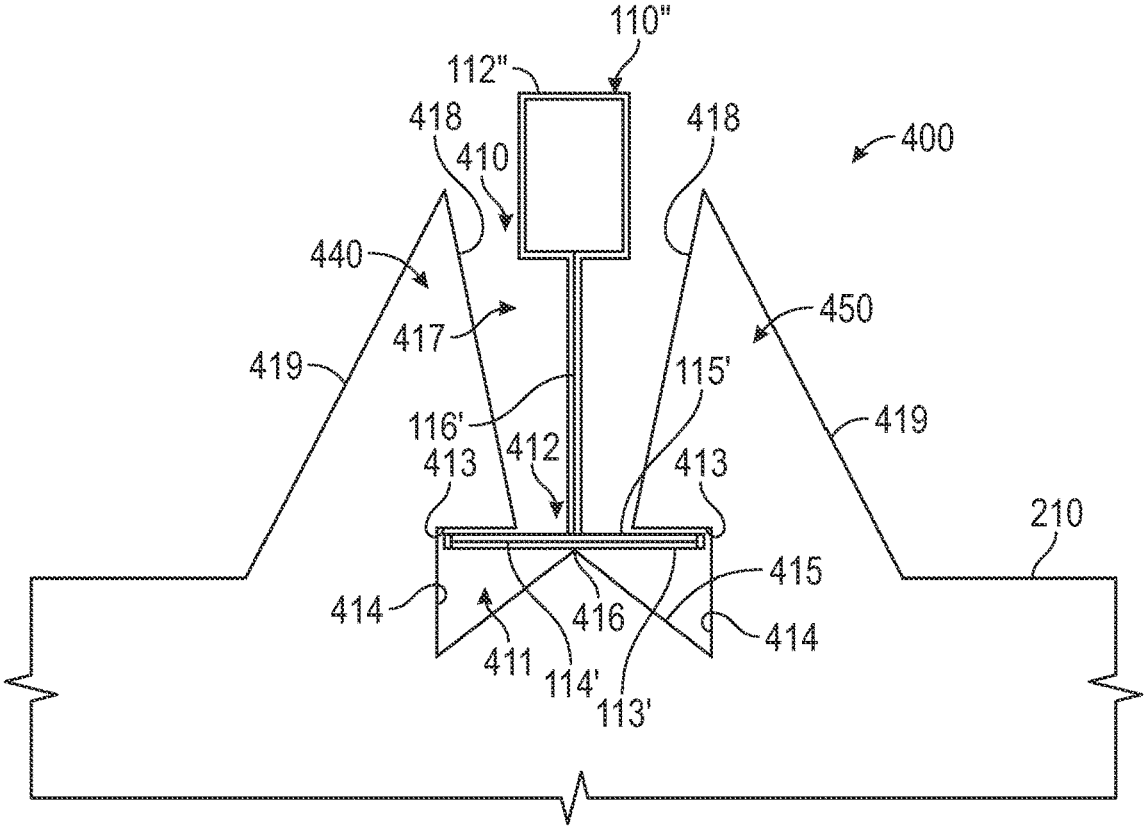
FIG. 5 illustrates a detailed view of an attachment mechanism of an acoustic ceiling baffle according to another embodiment of the present disclosure.

Different sized attachment mechanisms 250 may be utilized depending on need and based on the runners 110 used or on any other device for which the ceiling baffle attaches. FIGS. 4 and 5 illustrate attachment mechanisms that are configured to couple to a T grid runner. The attachment mechanisms may couple to the T grid runner via a snap fit. Examples of T grid runners include USG Centricitee, Armstrong Suprafine, Rockfron Tempera, Certainteed 9/16" Elite Narrow Stab System, and Gordon Series C-1A.

Figure 6:
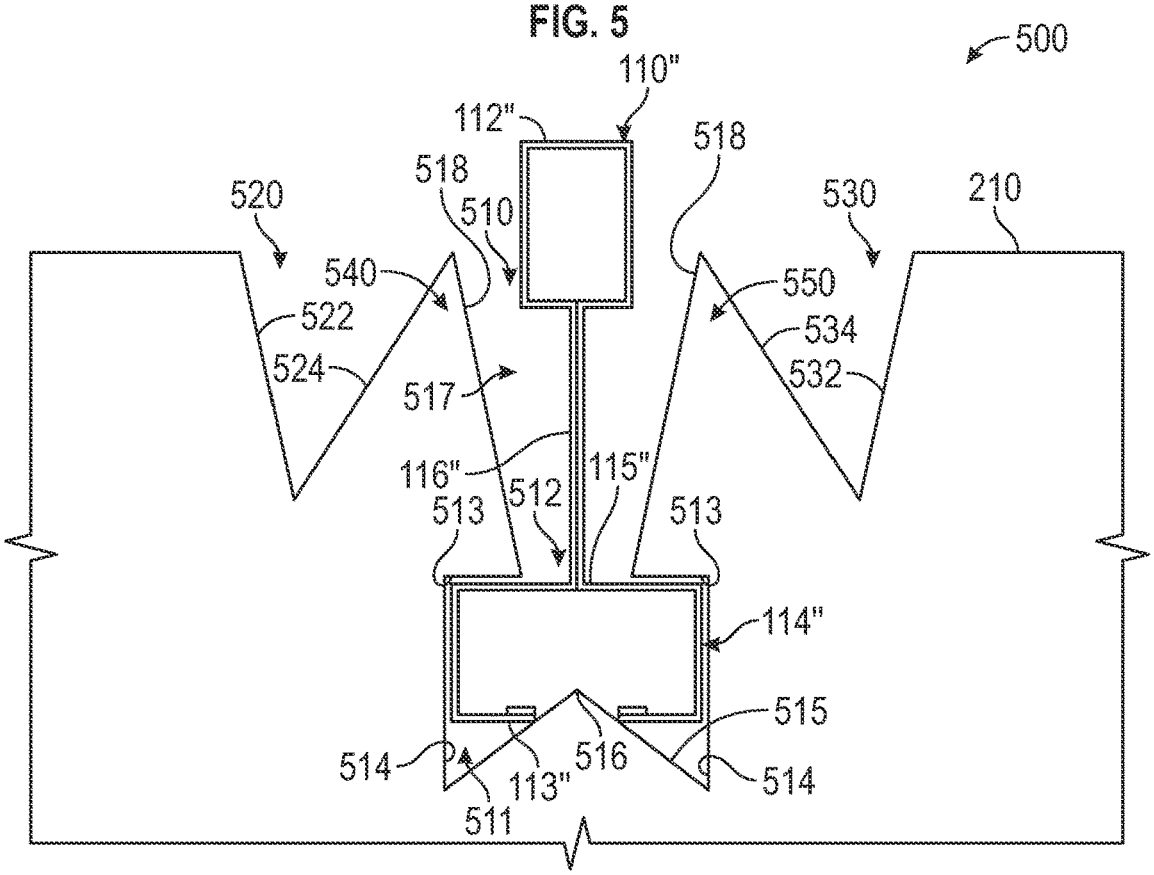
FIG. 6 illustrates a detailed view of an attachment mechanism of an acoustic ceiling baffle according to another embodiment of the present disclosure.
Figure 7:
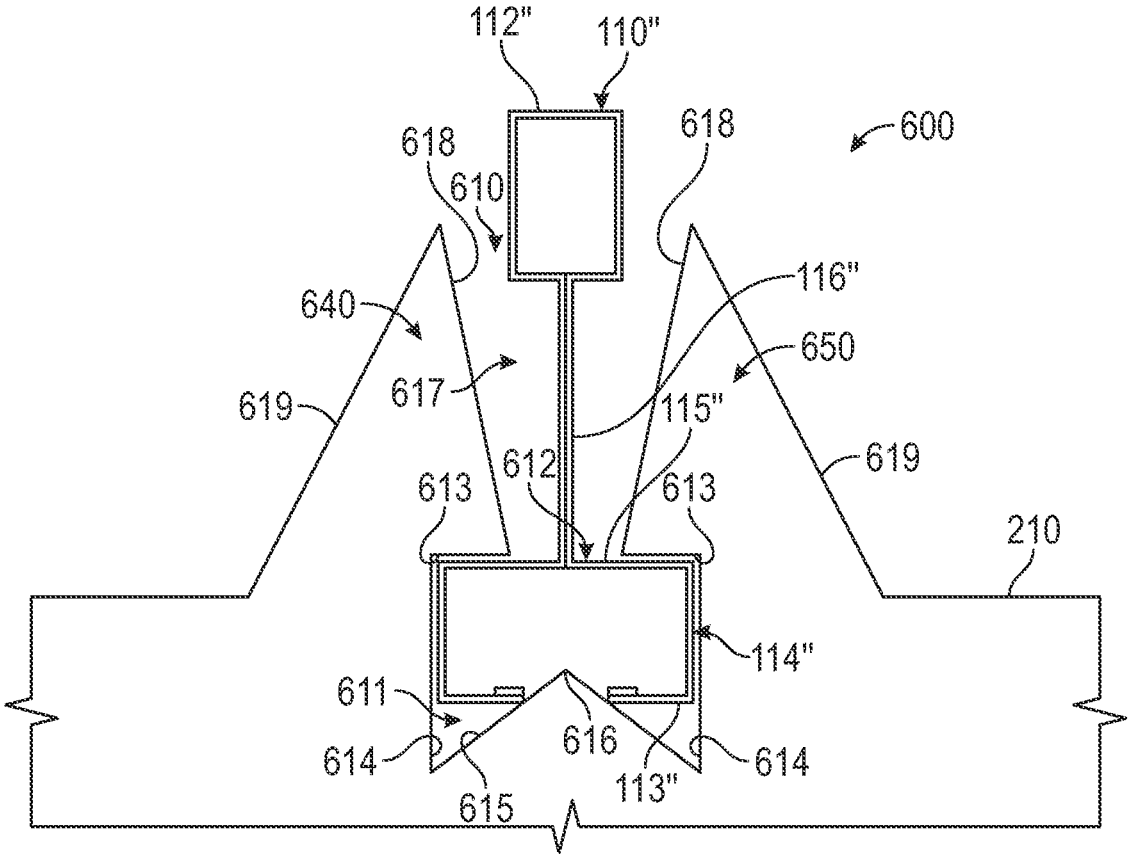
FIG. 7 illustrates a detailed view of an attachment mechanism of an acoustic ceiling baffle according to another embodiment of the present disclosure.

FIGS. 6 and 7 illustrate attachment mechanisms that are configured to couple to a bolt slot grid runner. The attachment mechanisms may couple to the bolt slot grid runner via a snap fit. Examples of blot slot grid runners include the USG Fineline, Armstrong Silhouette, Rockfron Ultraline, and Gordon Series A and B.

FIG. 4 illustrates a detailed view of an attachment mechanism 300 of the ceiling baffle 200 according to one embodiment. As discussed above, the attachment mechanism 300 is configured to couple to a T grid runner 110'. The runner 110' includes a blub 112', a face 114', and a web 116'.

The attachment mechanism 300 is formed within the top edge 210 of the ceiling baffle 200 and below a plane that corresponds with the top edge 210 of the ceiling baffle 200. In some embodiments, a portion of the attachment mechanism 300 may be disposed above the plane of the top edge 210. The attachment mechanism 300 may be formed in the ceiling baffle 200 by cutting away a portion of the ceiling baffle 200 to form the attachment mechanism 300.

The attachment mechanism 300 comprises a first recessed portion 310, a second recessed portion 320, and a third recessed portion 330. The first recessed portion 310, the second recessed portion 320, and the third recessed portion 330 form a pair of retention members 340 and 350. The first and second retention members 340 and 350 are formed around the first recessed portion 310. The runner 110' is configured to be inserted into the first recessed portion 310, and the retention members 340 and 350 are configured to retain the runner 110' in the first recessed portion 310 when the ceiling baffle 200 is coupled to the runner 110'.

The first recessed portion 310 comprises a first section 311 and a second section 317. The first section 311 has a generally rectangular shape with an opening 312 between the first section 311 and the second section 317. The first section 311 further includes top edges 313 that form the opening 312, side walls 314, and a bottom edge 315. The top edges 313 are bottom edges of the retention members 340 and 350, respectfully. The bottom edge 315 slants upward from each side wall 314 to form an apex 316 at a center of the bottom edge 315. The apex 316 is configured to engage with a bottom surface 113' of the face 114' of the runner 110', and the top edges 313 are configured to engage with a top surface 115' of the face 114' of the runner 110'. The second section 317 comprises side walls 318 that slant downward from the plane of the top edge 210 of the ceiling baffle 200 toward the opening 312. The side walls 318 are also side walls of the retention members 340 and 350, respectfully.

The second recessed portion 320 and the third recessed portion 330 are disposed on opposing sides of the first recessed portion 310. The second recessed portion 320 and the third recessed portion 330 may have a substantially triangular shape that is disposed below the plane of the top edge 210 of the ceiling baffle 200. The second recessed portion 320 and the third recessed portion 330 may be equal in size. Other shapes of the second recessed portion 320 and the third recessed portion 330 are within the scope of the present disclosure. In the illustrated embodiment, the second recessed portion 320 and the third recessed portion 330 each include a first side wall 322, 332 and a second side wall 324, 334. The second side walls 324, 334 are also part of the retention members 340 and 350, respectfully. The length of the first side wall 322, 332 is less than the length of the second side wall 324, 334, and the absolute value of the slope of the first side wall 322, 332 is greater than the absolute value of the slope of the second side wall 324, 334.

During the installation process, the first recessed portion 310 is pressed against the face 114' of the runner 110'. The outer edges of the face 114' engage with the side walls 318 of the second section 317 of the first recessed portion 310. While the face 114' applies a force against the side walls 318, the retention members 340 and 350 are configured to rotate inward and downward and partially into the first section 311 until the face 114' passes the opening 312. Once the face 114' passes the opening 312 into the first section 311, the retention members 340 and 350 rotate upward and outward to their original positions. Additionally, the bottom surface 113' of the face 114' engages with the apex 316 and the apex 316 is configured to go downward as the face 114' engages it until the face 114' passes the opening 312 into the first section 311, at which point the apex 316 returns to its original position.

The bottom surfaces 313 of the retention members 340 and 350 engage with the top surface 115' of the face 114' to hold the ceiling baffle 200 up. The apex 316 engages with the bottom surface 113' of the face 114' to secure the ceiling baffle 200 to the runner 110' and prevent movement of the ceiling baffle 200 after installation, thus ensuring a snug fit.

During the removal process, the retention members 340 and 350 may be rotated outward into the second recessed portion 320 and the third recessed portion 330, respectfully. By rotating the retention member 340 into the second recessed portion 320 and rotating the retention member 350 into the third recessed portion 330, the opening 312 is opened enough to allow the face 114' of the runner 110' to pass through the opening 312 and decouple the ceiling baffle 200 to the runner 110'.

FIG. 5 illustrates a detailed view of an attachment mechanism 400 of the ceiling baffle 200 according to another embodiment. As discussed above, the attachment mechanism 400 is configured to couple to a T grid runner 110'. The runner 110' includes a blub 112', a face 114', and a web 116'.

The attachment mechanism 400 is formed within and above the top edge 210 of the ceiling baffle 200 and above and below the plane that corresponds with the top edge 210 of the ceiling baffle 200. The attachment mechanism 400 may be formed in the ceiling baffle 200 by cutting away a portion of the ceiling baffle 200 to form the attachment mechanism 400 and the top edge 210 of the ceiling baffle.

The attachment mechanism 400 comprises a recessed portion 410 and a pair of retention members 440 and 450. The first and second retention members 440 and 450 are formed around the first recessed portion 410. The runner 110' is configured to be inserted into the first recessed portion 410, and the retention members 440 and 450 are configured to retain the runner 110' in the first recessed portion 410 when the ceiling baffle 200 is coupled to the runner 110'.

The first recessed portion 410 comprises a first section 411 and a second section 417. The first section 411 is disposed above and below the plane of the top edge 210 of the ceiling baffle and the second section 417 is disposed above the plane. The first section 411 has a generally rectangular shape with an opening 412 between the first section 411 and the second section 417. The first section 411 further includes top edges 413 that form the opening 412, side walls 414, and a bottom edge 415. The top edges 413 are bottom edges of the retention members 440 and 450, respectfully. The bottom edge 415 slants upward from each side wall 414 to form an apex 416 at a center of the bottom edge 415. The apex 416 is configured to engage with a bottom surface 113' of the face 114' of the runner 110', and the top edges 413 are configured to engage with a top surface 115' of the face 114' of the runner 110'. The second section 417 comprises side walls 418 that slant downward toward the opening 412. The side walls 418 are also side walls of the retention members 440 and 450, respectfully.

The retention members 440 and 450 may have a substantially triangular shape that is disposed above the plane of the top edge 210 of the ceiling baffle 200. The retention members 440 and 450 may be equal in size. Other shapes of the retention members 440 and 450 are within the scope of the present disclosure. In the illustrated embodiment, retention members 440 and 450 each include an outer side wall 419. The length of the side wall 418 is less than the length of the outer side walls 419, and the absolute value of the slope of the side walls 418 is greater than the absolute value of the slope of the outer side walls 419.

During the installation process, the first recessed portion 410 is pressed against the face 114' of the runner 110'. The outer edges of the face 114' engage with the side walls 418 of the second section 417 of the first recessed portion 410. While the face 114' applies a force against the side walls 418, the retention members 440 and 450 are configured to rotate inward and downward and partially into the first section 411 until the face 114' passes the opening 412. Once the face 114' passes the opening 412 into the first section 411, the retention members 440 and 450 rotate upward and outward to their original positions. Additionally, the bottom surface 113' of the face 114' engages with the apex 416 and the apex 416 is configured to go downward as the face 114' engages it until the face 114' passes the opening 412 into the first section 411, at which point the apex 416 returns to its original position.

The bottom surfaces 413 of the retention members 440 and 450 engage with the top surface 115' of the face 114' to hold the ceiling baffle 200 up. The apex 416 engages with the bottom surface 113' of the face 114' to secure the ceiling baffle 200 to the runner 110' and prevent movement of the ceiling baffle 200 after installation, thus ensuring a snug fit.

During the removal process, the retention members 440 and 450 may be rotated outward. By rotating the retention members 440 and 450 outward, the opening 412 is opened enough to allow the face 114' of the runner 110' to pass through the opening 412 and decouple the ceiling baffle 200 to the runner 110'.

FIG. 6 illustrates a detailed view of an attachment mechanism 500 of the ceiling baffle 200 according to another embodiment. As discussed above, the attachment mechanism is configured to couple to a blot slot grid runner 110". The runner 110" includes a blub 112", a face 114", and a web 116". The bulb 112" and the web 116" are similar to the runner 110', but the face 114' is different. The face 114" has a rectangular cross-section with an opening on the bottom surface 113" of the face 114'.

The attachment mechanism 500 is formed within the top edge 210 of the ceiling baffle 200 and below a plane that corresponds with the top edge 210 of the ceiling baffle 200. In some embodiments, a portion of the attachment mechanism 500 may be disposed above the plane of the top edge 210. The attachment mechanism 500 may be formed in the ceiling baffle 200 by cutting away a portion of the ceiling baffle 200 to form the attachment mechanism 500.

The attachment mechanism 500 comprises a first recessed portion 510, a second recessed portion 520, and a third recessed portion 530. The first recessed portion 510, the second recessed portion 520, and the third recessed portion 530 form a pair of retention members 540 and 550. The first and second retention members 540 and 550 are formed around the first recessed portion 510. The runner 110" is configured to be inserted into the first recessed portion 510 and the retention members 540 and 550 are configured to retain the runner 110" in the first recessed portion 510 when the ceiling baffle 200 is coupled to the runner 110".

The first recessed portion 510 comprises a first section 511 and a second section 517. The first section 511 has a generally rectangular shape with an opening 512 between the first section 511 and the second section 517. The first section 511 of the present embodiment is bigger than the first section 311, previously discussed, because of the enlarged face 114". The first section 511 further includes top edges 513 that form the opening 512, side walls 514, and a bottom edge 515. The top edges 513 are bottom edges of the retention members 540 and 550, respectfully. The bottom edge 515 slants upward from each side wall 514 to form an apex 516 at a center of the bottom edge 515. The slope of the bottom edge 515 is greater than the slope of the bottom edge 315 previously discussed. The apex 516 is configured to engage with a bottom surface 113" of the face 114" of the runner 110", and the top edges 513 are configured to engage with a top surface 115" of the face 114" of the runner 110". The second section 517 comprises side walls 518 that slant downward from the plane of the top edge 210 of the ceiling baffle 200 toward the opening 512. The side walls 518 are also side walls of the retention members 540 and 550 respectfully.

The second recessed portion 520 and the third recessed portion 530 are disposed on opposing sides of the first recessed portion 510. The second recessed portion 520 and the third recessed portion 530 may have a substantially triangular shape that is disposed below the plane of the top edge 210 of the ceiling baffle 200. The second recessed portion 520 and the third recessed portion 530 may be equally size. Other shapes of the second recessed portion 520 and the third recessed portion 530 are within the scope of the present disclosure. In the illustrated embodiment, the second recessed portion 520 and the third recessed portion 530 each include a first side wall 522, 532 and a second side wall 524, 534. The second side walls 524, 534 are also part of the retention members 540 and 550, respectfully. The length of the first side wall 522, 532 is less than the length of the second side wall 524, 534, and the absolute value of the slope of the first side wall 522, 532 is greater than the absolute value of the slope of the second side wall 524, 534.

During the installation process, the first recessed portion 510 is pressed against the face 114" of the runner 110'. The outer edges of the face 114" engage with the side walls 518 of the second section 517 of the first recessed portion 510. While the face 114" applies a force against the side walls 518, the retention members 540 and 550 are configured to rotate inward and downward and partially into the first section 511 until the face 114" passes the opening 512. Once the face 114" passes the opening 512 into the first section 511, the retention members 540 and 550 rotate upward and outward to their original positions. Additionally, the bottom surface 113" of the face 114" engages with the bottom edge 515 and the apex 516 is configured to go into the opening of the bottom surface 113" until the face 114" passes the opening 512 into the first section 511, at which point the apex 516 returns to its original position.

The bottom surfaces 513 of the retention members 540 and 550 engage with the top surface 115" of the face 114" to hold the ceiling baffle 200 up. The bottom edge 515 engages with the bottom surface 113" of the face 114" with the apex 516 in an opening in the face 114" to secure the ceiling baffle 200 to the runner 110" and prevent movement of the ceiling baffle 200 after installation, thus ensuring a snug fit.

During the removal process, the retention members 540 and 550 may be rotated outward into the second recessed portion 520 and the third recessed portion 530, respectfully. By rotating the retention member 540 into the second recessed portion 520 and rotating the retention member 550 into the third recessed portion 530, the opening 512 is opened enough to allow the face 114" of the runner 110" to pass through the opening 512 and decouple the ceiling baffle 200 to the runner 110".

FIG. 7 illustrates a detailed view of an attachment mechanism 600 of the ceiling baffle 200 according to another embodiment. As discussed above, the attachment mechanism is configured to couple to a blot slot grid runner 110". The runner 110" includes a blub 112", a face 114", and a web 116".

The attachment mechanism 600 is formed within and above the top edge 210 of the ceiling baffle 200 and above and below the plane that corresponds with the top edge 210 of the ceiling baffle 200. The attachment mechanism 600 may be formed in the ceiling baffle 200 by cutting away a portion of the ceiling baffle 200 to form the attachment mechanism 600 and the top edge 210 of the ceiling baffle 200.

The attachment mechanism 600 comprises a recessed portion 610 and a pair of retention members 640 and 650. The first and second retention members 640 and 650 are formed around the first recessed portion 610. The runner 110" is configured to be inserted into the first recessed portion 610 and the retention members 640 and 650 are configured to retain the runner 110" in the first recessed portion 610 when the ceiling baffle 200 is coupled to the runner 110".

The first recessed portion 610 comprises a first section 611 and a second section 617. The first section 611 is disposed above and below the plane of the top edge 210 of the ceiling baffle 200 and the second section 617 is disposed above the plane. The first section 611 has a generally rectangular shape with an opening 612 between the first section 611 and the second section 617. The first section 611 of the present embodiment is bigger than the first section 311, previously discussed, because of the enlarged face 114". The first section 611 further includes top edges 613 that form the opening 612, side walls 614, and a bottom edge 615. The top edges 613 are bottom edges of the retention members 640 and 650, respectfully. The bottom edge 615 slants upward from each side wall 614 to form an apex 616 at a center of the bottom edge 615. The apex 616 is configured to engage with a bottom surface 113" of the face 114" of the runner 110", and the top edges 613 are configured to engage with a top surface 115" of the face 114" of the runner 110". The second section 617 comprises side walls 618 that slant downward toward the opening 612. The side walls 618 are also side walls of the retention members 640 and 650, respectfully.

The retention members 640 and 650 may have a substantially triangular shape that is disposed above the plane of the top edge 210 of the ceiling baffle 200. The retention members 640 and 650 may be equally size. Other shapes of the retention members 640 and 650 are within the scope of the present disclosure. In the illustrated embodiment, retention members 640 and 650 each include an outer side wall 619. The length of the side wall 618 is less than the length of the outer side walls 619, and the absolute value of the slope of the side walls 618 is greater than the absolute value of the slope of the outer side walls 619.

During the installation process, the first recessed portion 610 is pressed against the face 114" of the runner 110". The outer edges of the face 114" engage with the side walls 618 of the second section 617 of the first recessed portion 610. While the face 114' applies a force against the side walls 618, the retention members 640 and 650 are configured to rotate inward and downward and partially into the first section 611 until the face 114" passes the opening 612. Once the face 114" passes the opening 612 into the first section 611, the retention members 640 and 650 rotate upward and outward to their original positions. Additionally, the bottom surface 113" of the face 114" engages with the apex 616 and the apex 616 is configured to go downward as the face 114" engages it until the face 114" passes the opening 612 into the first section 611, at which point the apex 616 returns to its original position.

The bottom surfaces 613 of the retention members 640 and 650 engage with the top surface 115" of the face 114" to hold the ceiling baffle 200 up. The bottom edge 615 engages with the bottom surface 113" of the face 114" with the apex 616 in an opening in the face 114" to secure the ceiling baffle 200 to the runner 110" and prevent movement of the ceiling baffle 200 after installation, thus ensuring a snug fit.

During the removal process, the retention members 640 and 650 may be rotated outward. By rotating the retention members 640 and 650 outward, the opening 612 is opened enough to allow the face 114" of the runner 110" to pass through the opening 612 and decouple the ceiling baffle 200 to the runner 110".

Methods of using and/or making an acoustic system are also disclosed herein. In particular, it is contemplated that any of the components, principles, and/or embodiments discussed above may be utilized in either an acoustic system or a method of using and/or making the same.

It will be appreciated that any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

The invention claimed is:

1. An acoustic ceiling baffle comprising:

a baffle body;

an attachment mechanism disposed on a top edge of the baffle body configured to couple and decouple from a runner of a ceiling suspension system, wherein the attachment mechanism comprises:

a first recessed portion configured to receive the runner, the first recessed portion comprising a first section and a second section with an opening disposed between the first section and the second section, wherein the first section is configured to engage with a face of the runner when the acoustic ceiling baffle is coupled to the runner;

a first retention member and a second retention member, each retention member comprising a side wall that slants downward toward the opening between the first section and the second section, each retention member comprising a bottom edge that is configured to engage with a top surface of a face of the runner, wherein opposing top edges of the first section across the opening correspond with the bottom edges of each retention member, and wherein a bottom edge of the first section forms an apex at a center of the bottom edge that is configured to engage with a bottom surface of the runner.

2. The acoustic ceiling baffle of claim 1, wherein the attachment mechanism is disposed below a plane of the top edge of the baffle body.

3. The acoustic ceiling baffle of claim 1, wherein the attachment mechanism is disposed above and below a plane of the top edge of the baffle body.

4. The acoustic ceiling baffle of claim 1, wherein the first section of the first recessed portion is disposed above and below a plane of the top edge of the baffle body.

5. The acoustic ceiling baffle of claim 1, wherein the baffle body comprises two attachment mechanisms disposed on the top edge of the baffle body.

6. The acoustic ceiling baffle of claim 1, wherein the baffle body comprises three attachment mechanisms disposed on the top edge of the baffle body.

7. The acoustic ceiling baffle of claim 1, wherein the first retention member and the second retention member have a substantially triangular shape.

8. The acoustic ceiling baffle of claim 1, wherein the first retention member and the second retention member are rotatable inward and outward.

9. The acoustic ceiling baffle of claim 1, wherein the first section of the first recessed portion comprises a substantially rectangular shape and a bottom edge of the first section slants upwards from side walls.

10. The acoustic ceiling baffle of claim 1, wherein a bottom edge of the first section is configured to engage with a bottom surface of the face of the runner when the face is disposed within the first section.

11. The acoustic ceiling baffle of claim 1, wherein the bottom edge of the first section slants upward from side walls to form the apex.

12. The acoustic ceiling baffle of claim 1, wherein the side walls slant toward one another.

13. The acoustic ceiling baffle of claim 1, further comprising a second recessed portion and a third recessed portion, wherein the second recessed portion and the third recessed portion are disposed on opposing side of the first recessed portion and the first and second retention members.

14. The acoustic ceiling baffle of claim 13, wherein the first recessed portion and the second recessed portion are substantially triangular shaped.

15. The acoustic ceiling baffle of claim 1, wherein the attachment mechanism is configured to couple to a T grid runner via a snap fit.

16. The acoustic ceiling baffle of claim 1, wherein the attachment mechanism is configured to couple to a bolt slot grid runner via a snap fit.

17. An acoustic ceiling baffle comprising:

a baffle body;

an attachment mechanism disposed on a top edge of the baffle body configured to couple and decouple from a runner of a ceiling suspension system, wherein the attachment mechanism comprises:

a first recessed portion configured to receive the runner, the first recessed portion comprising a first section and a second section with an opening disposed between the first section and the second section, wherein the first section is configured to engage with a face of the runner when the acoustic ceiling baffle is coupled to the runner, wherein a bottom edge of the first section slants upward from side walls to form an apex, and wherein a bottom edge of the first section is configured to engage with a bottom surface of a face of the runner when the face is disposed within the first section;

a first retention member and a second retention member, each retention member comprising a bottom edge that is configured to engage with a top surface of the face of the runner, wherein opposing top edges of the first section across the opening correspond with the bottom edges of each retention member.

18. The acoustic ceiling baffle of claim 17, wherein the first retention member and the second retention member are rotatable inward and outward.

19. A ceiling suspension system comprising:

a plurality of runners that extend parallel to each other;

a plurality of acoustic ceiling baffles configured to couple to the runners, each acoustic ceiling baffle comprising:

a baffle body;

an attachment mechanism disposed on a top edge of the baffle body configured to couple and decouple from the runner, wherein the attachment mechanism comprises:

a first recessed portion configured to receive the runner, the first recessed portion comprising a first section and a second section with an opening disposed between the first section and the second section, wherein the first section is configured to engage with a face of the runner when the acoustic ceiling baffle is coupled to the runner;

a first retention member and a second retention member, each retention member comprising a bottom edge that is configured to engage with a top surface of a face of the runner, wherein opposing top edges of the first section across the opening correspond with the bottom edges of each retention member, and wherein a bottom edge of the first section forms an apex at a center of the bottom edge that is configured to engage with a bottom surface of the runner.

20. The ceiling suspension system of claim 19, wherein a number of attachment mechanisms for each acoustic ceiling baffle corresponds to a number of runners in the ceiling suspension system.

* * * * *